United States Patent [19]

Radtke

[11] Patent Number: 4,494,618

[45] Date of Patent: Jan. 22, 1985

[54] DRILL BIT WITH SELF CLEANING NOZZLE

[75] Inventor: Robert P. Radtke, Kingwood, Tex.

[73] Assignee: Strata Bit Corporation, Houston, Tex.

[21] Appl. No.: 430,986

[22] Filed: Sep. 30, 1982

[51] Int. Cl.[3] ..... E21B 10/60

[52] U.S. Cl. ..... 175/393; 175/422

[58] Field of Search ..... 175/393, 339, 340, 343, 175/417, 418, 400, 422; 239/601, 590.5, 104, 462

[56] References Cited

U.S. PATENT DOCUMENTS

| | | | |
|---|---|---|---|
| 2,152,628 | 4/1939 | Gauthey | 175/339 X |
| 2,166,478 | 7/1939 | Riblet | 175/400 X |
| 3,645,331 | 2/1972 | Maurer | 175/393 X |
| 3,785,560 | 1/1974 | Hruby, Jr. | 239/601 X |
| 4,022,286 | 5/1977 | Gill | 175/393 X |
| 4,372,399 | 2/1983 | Cork | 175/422 X |

FOREIGN PATENT DOCUMENTS

| | | | |
|---|---|---|---|
| 2755993 | 6/1978 | Fed. Rep. of Germany | 239/601 |
| 293645 | 7/1928 | United Kingdom | 175/417 |

*Primary Examiner*—James A. Leppink
*Assistant Examiner*—Michael Starinsky
*Attorney, Agent, or Firm*—Burns, Doane, Swecker & Mathis

[57] ABSTRACT

A drill bit for connection on a drill string has a hollow tubular body with an end cutting face and an exterior peripheral stabilizer surface with cylindrical sintered carbide inserts positioned therein. Nozzle passages extend from the interior of the bit body through the cutting face for receiving a removable and interchangeable nozzle member therein. The nozzle has a fluted or non-circular cross-section with grooved portions or out of round portions providing sufficient clearance for drilling fluid to continue to flow through the nozzle even when the main passage thereof is blocked with mud particles or the like. The cutting face has a plurality of recesses therein which receive, by an interference fit, a plurality of cutting elements of the type known as Stratapax, consisting of a cylindrical stud having an angular supporting surface with a cutting disc bonded thereon consisting of sintered carbide having a cutting surface of polycrystalline diamond. The recesses in the cutting face have milled offset recesses adjacent to the edges thereof which are sized and positioned to permit the cutting discs to be partially recessed and to restrain the cutting elements from rotation during use.

4 Claims, 17 Drawing Figures

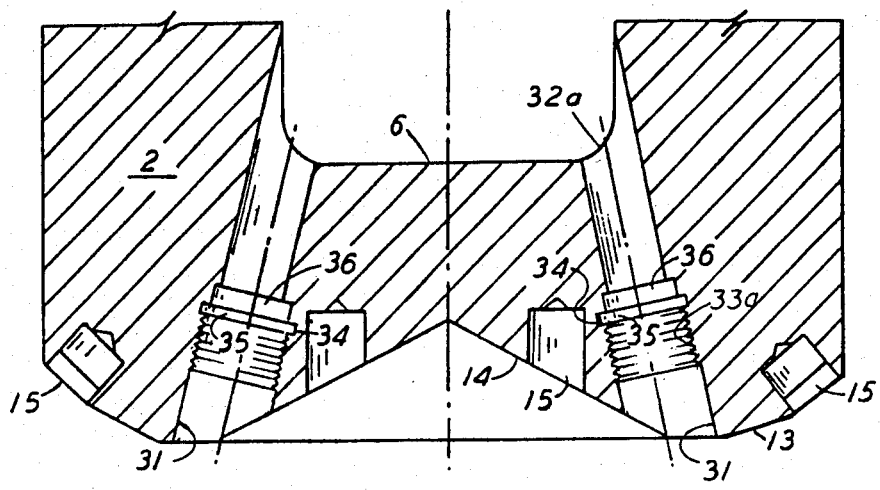
FIG. 10
FIG. 11
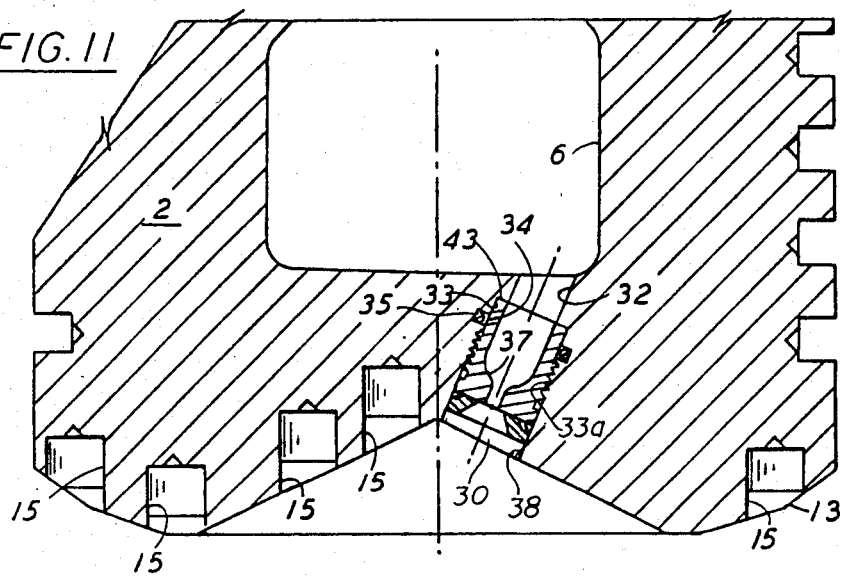
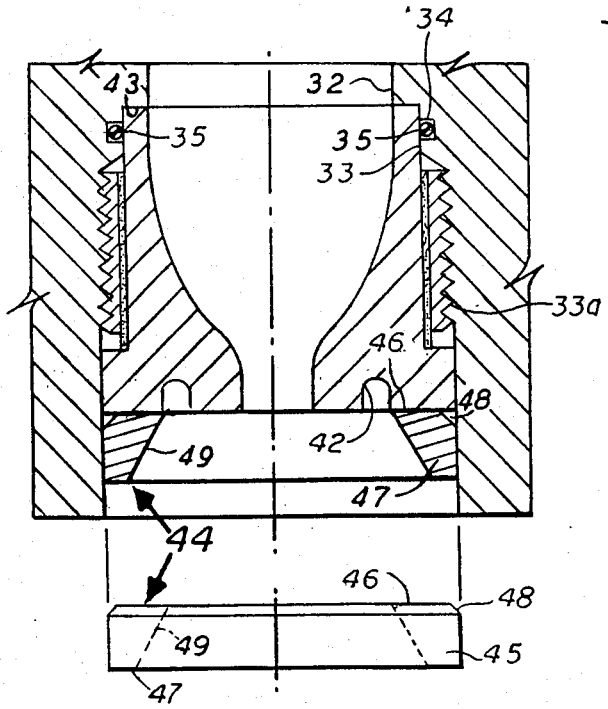
FIG. 12

DRILL BIT WITH SELF CLEANING NOZZLE

CROSS-REFERENCE TO RELATED APPLICATIONS

This application includes subject matter disclosed in part in co-pending applications Ser. No. 220,306, filed Dec. 29, 1980 (now abandoned), Ser. No. 158,389, filed June 11, 1980, now U.S. Pat. No. 4,323,130, Ser. No. 296,811, filed Aug. 27, 1981, now U.S. Pat. No. 4,381,825, Ser. No. 303,721, filed Sept. 21, 1981, now U.S. Pat. No. 4,396,077, and Ser. No. 303,960, filed Sept. 21, 1981, now U.S. Pat. No. 4,442,909.

BACKGROUND OF THE INVENTION

1. Field of the Invention

This invention relates to new and useful improvements in removable nozzles for drill bits and more particularly for nozzles for use in diamond drill bits.

2. Brief Description of the Prior Art

Rotary drill bits used in earth drilling are primarily of two major types. One major type of drill bit is the roller cone bit having three legs depending from a bit body which support three roller cones carrying tungsten carbide teeth for cutting rock and other earth formations. Another major type of rotary drill bit is the diamond bit which has fixed teeth of industrial diamonds supported on the drill body or on metallic or carbide studs or slugs anchored in the drill body.

It is well known in both types of drill bit to provide nozzle passages for circulating drilling fluid from the interior of the drill bit in a jet toward the point where the cutters engage the bottom of the hole. In roller cone type bits there has been a substantial amount of activity, mostly in the 1950s and 60s, in the development of removable nozzles. In diamond type drill bits, most bit bodies have been provided with fixed nozzle passages. Removable nozzles have been difficult to apply to diamond drill bits because of the proximity of the nozzle to the cutting surface which results in a very rapid erosion of the snap ring retainers for the nozzle members.

Replaceable nozzles have been developed in the past. These nozzles have been retained in a fluid discharge bore in the bit body by abutting their upper ends against shoulders in the bore and then inserting snap rings into grooves at the lower end of the nozzle. The drilling fluid is very abrasive and the exposure of the snap rings as well as the bit body at the lower end of the nozzle adjacent to the snap ring groove to the wash of the drilling fluid has caused this snap ring as well as the body portion supporting it to erode and fail, permitting the nozzle to be lost into the bottom of the hole.

This structural arrangement, wherein the snap ring and its support are continually exposed to drilling fluid, together with the fact that higher drilling fluid jet velocities and consequently high pressure differentials across the nozzle are being used, combined to make the snap ring somewhat unsatisfactory in many cases for retaining nozzles in the bit body. A variety of patents have been granted on arrangements which attempt to solve this problem in roller cone bits.

Payne U.S. Pat. No. 2,855,182 discloses a replaceable nozzle for a roller cone type bit which is provided with a peripheral sealing ring and is held in place by a snap ring adjacent the discharge end of the nozzle.

Sease U.S. Pat. No. Re. 25,452 (of U.S. Pat. No. 2,868,512) discloses a nozzle which is substantially the same as that shown in Payne but provided with a rubber sealing ring protecting the end of the nozzle against abrasion.

Scarborough U.S. Pat. No. 3,084,751 discloses a roller cone bit having replaceable nozzles secured in position by retaining pins located away from the abrasive environment at the end of the nozzle. This structure is somewhat difficult to manufacture.

Steen U.S. Pat. No. 3,096,834 discloses a replaceable jet nozzle for rock bits having a rubber shield at the lower face of a metal retainer ring.

Mandrell U.S. Pat. No. 3,115,200 discloses a removable nozzle for a drill bit having an improved arrangement for accessibility of a snap ring for retaining the nozzle in place.

Crawford U.S. Pat. No. 3,137,354 discloses removable drill bit nozzles secured in place by set screws.

Neilson U.S. Pat. No. 3,207,241 discloses removable drill bit nozzles secured in place by threaded retaining sleeves.

The copending application Ser. No. 220,306, filed Dec. 29, 1980, discloses an improved arrangement for securing replaceable nozzles in drilling bits by means of a metal or hard metal retaining ring.

A problem which arises from time to time with drilling nozzles is the plugging of the nozzles with particles in the drilling fluid. This is particularly true when drilling with drilling muds. In such a case a large mud particle can seal off the nozzle and completely plug the flow of the drilling mud.

There are a variety of prior art patents which deal with the replacability of nozzles but very little dealing with the problem of nozzle plugging.

Gatien U.S. Pat. No. 3,370,659 discloses a rubber valve for controlling flow in a hollow drill bit. The valve opens up to allow passage of particles.

Gray U.S. Pat. No. 1,793,547 and Hollingshead U.S. Pat. No. 3,686,601 show drill stems provided with check valves.

Thagard U.S. Pat. No. 1,639,065 discloses a bit having a ball check valve with a passage which is enlarged at one point to permit flow around the ball valves.

None of these references, and no other prior art known to this inventor offers a solution to the problem of plugged nozzles.

There are several types of diamond bits known to the drilling industry. In one type, the diamonds are a very small size and randomly distributed in a supporting matrix. Another type contains diamonds of a larger size positioned on the surface of a drill shank in a predetermined pattern. Still another type involves the use of a cutter formed of a polycrystalline diamond supported on a sintered carbide support.

Some of the most recent publications dealing with diamond bits of advanced design, relevant to this invention, consists of Rowley, et al. U.S. Pat. No. 4,073,354 and Rohde, et al. U.S. Pat. No. 4,098,363. An example of cutting inserts using polycrystalline diamond cutters and an illustration of a drill bit using such cutters, is found in Daniels, et al. U.S. Pat. No. 4,156,329.

The most comprehensive treatment of this subject in the literature is probably the chapter entitled Stratapax bits, pages 541–591 in Advanced Drilling Techniques, by William C. Maurer, The Petroleum Publishing Company, 1421 South Sheridan Road, P.O. Box 1260, Tulsa, Okla., 74101, published in 1980. This reference illustrates and discusses in detail the development of the STRATAPAX diamond cutting elements by General Electric and gives several examples of commercial drill bits and prototypes using such cutting elements.

These patents and the cited literature show the construction of various diamond bits and related prior art but do not consider the problem of nozzle retention in diamond bits adjacent to the cutting surface of the bit or nozzle plugging by mud particles.

SUMMARY OF THE INVENTION

One of the objects of this invention is to provide a new and improved drill bit having removable and replaceable nozzles with a self cleaning configuration.

Another object is to provide a drill bit having removable and replaceable nozzles secured in fluid passages or bores in the drill body and having a cross sectional configuration which permits fluid flow even when the main nozzle passage is plugged.

Another object is to provide a drill bit having removable and replaceable nozzles secured in fluid passages or bores in the drill body which have fluted or non-circular cross-sections which permit flow around a particle plugging the main nozzle passage so that continued flow washes away the material plugging the nozzle.

Other objects and features of this invention will become apparent from time to time throughout the specification and claims as hereinafter related.

The foregoing objectives are accomplished by a new and improved drill by a drill bit for connection on a drill string which has a hollow tubular body with an end cutting face and an exterior peripheral stabilizer surface with cylindrical sintered carbide inserts positioned therein. Nozzle passages extend from the interior of the bit body through the cutting face for receiving a removable and interchangeable nozzle member therein.

The nozzle has a fluted or non-circular cross-section with grooved portions or out of round portions providing sufficient clearance for drilling fluid to continue to flow through the nozzle even when the main passage thereof is blocked with mud particles or the like. The continued flow of mud or fluid washes away the particles which plug the main opening.

The cutting face has a plurality of recesses therein which receive, by an interference fit, a plurality of cutting elements of the type known as Stratapax, consisting of a cylindrical stud having an angular supporting surface with a cutting disc bonded thereon consisting of sintered carbide having a cutting surface of polycrystalline diamond. The recesses in the cutting face have milled offset recesses adjacent to the edges thereof which are sized and positioned to permit the cutting discs to be partially recessed and to restrain the cutting elements from rotation during use.

BRIEF DESCRIPTION OF THE DRAWINGS

FIG. 10 is a view in section taken on the line 10—10 of FIG. 2.

FIG. 11 is a sectional view taken on the line 11—11 of FIG. 2.

FIG. 12 is a detail, enlarged sectional view of the removable and replaceable nozzle member shown in FIGS. 1 and 11 with the retaining ring shown in a partially exploded relation.

DESCRIPTION OF THE PREFERRED EMBODIMENTS

Figure 1:
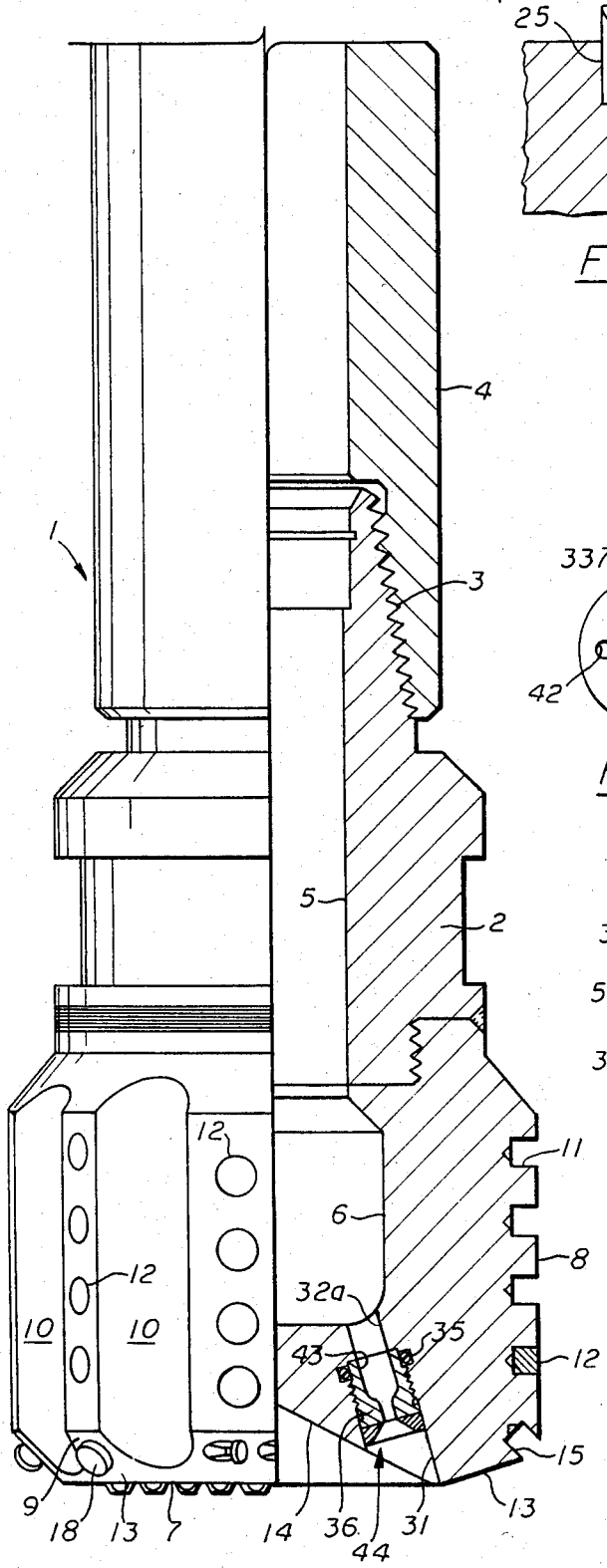
FIG. 1 is a view partly in elevation and partly in quarter section of an earth boring drill bit with diamond-containing cutting inserts incorporating a preferred embodiment of this invention.

Referring to the drawings by numerals of reference and more particularly to FIG. 1, there is shown a drill bit 1 having an improved arrangement for positioning the diamond insert cutters which represents a preferred embodiment of the invention. Drill bit 1 is illustrated as having replaceable drilling nozzles held in place by a threaded arrangement which is particularly useful in this bit because of the close proximity of the nozzles to the cutting surface of the bit and the bottom of the drill hole which results in a very high rate of wear.

The particular drill bit shown includes many features found in a drill bit described in the copending U.S. patent application of Mahlon Dennis, Ser. No. 158,389, filed June 11, 1980 and applicant's copending applications Ser. No. 220,306, filed Dec. 29, 1980 (which discloses an improved arrangement for securing replaceable nozzles in drilling bits by means of a metal or hard metal retaining ring) and Ser. No. 296,811, filed Aug. 27, 1981 (which discloses and claims the threaded arrangement for securing the nozzles in place).

Drill bit 1 comprises a tubular body 2 which is adapted to be connected as by a threaded connection 3 to a drill collar 4 in a conventional drill spring. The body 2 of drill bit 1 has a longitudinally extending passage 5 terminating in a cavity 6 formed by end wall 7 which is the cutting face of the drill bit.

Drill bit 1 has a peripheral stabilizer surface 8 which meets the cutting face 7 at the gage cutting edge portion 9. The stabilizer portion 8 is provided with a plurality of grooves or courses 10 which provide for flow of drilling mud or other drilling fluid around the bit during drilling operation. The stabilizer surface 8 is provided with a plurality of cylindrical holes or recesses 11 in which are positioned hard metal inserts 12. The hard metal inserts 12 are preferably of a sintered carbide and are cylindrical in shape and held in place in recesses 11 by an interference fit with the flat end of the insert being substantially flush with the stablizer surface 8.

Figure 3:
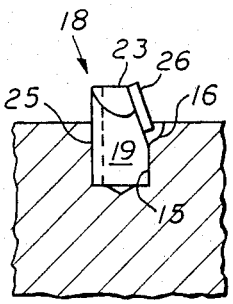
FIG. 3 is a sectional view taken normal to the surface of the drill bit through one of the recesses in which the cutting inserts are positioned and showing the insert in elevation.
Figure 4:
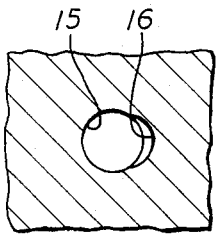
FIG. 4 is a sectional view in plan showing the hole or recess in which the cutting insert is positioned and the milled offset recess for the diamond cutter disc.

The cutting surface or cutting face 7 of the drill bit body 2 is preferably a crown surface defined by the intersection of outer conical surface 13 and inner negative conical surface 14. The crown surfaces 13 and 14 are provided with a plurality of sockets or recesses 15 spaced therearound in a selected pattern. As will be seen from the bottom plan view in FIG. 2, the sockets or recesses 15 and the cutting inserts which are positioned therein are arranged in substantially a spiral pattern. In FIGS. 3 and 4, the sockets or recesses 15 are shown in more detail with the cutting inserts being illustrated.

Each of the recesses 15 is provided with a milled offset recess 16 at the edge where the cutting surface 7 is intersected by the recess 15. Milled offset recess 16 is cut on one side of the hole or recess 15 and intersects substantially less than 180° of the circumference of the recess. The milled offset recesses are preferably of circular cross section taken longitudinally of recess 15 and circular cross section taken normal thereto. The milled offset recesses are sized to receive the cutting discs snugly, as described below.

Figure 2:
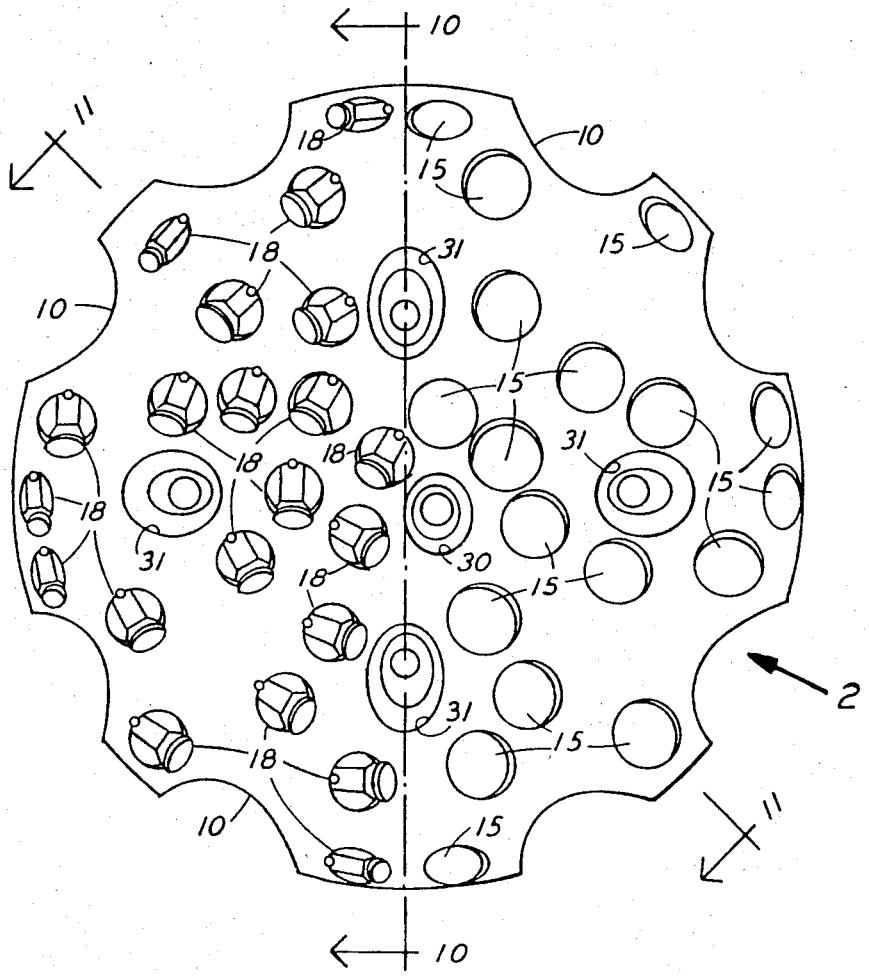
FIG. 2 is a plan view of the bottom of the drill bit shown in FIG. 1 showing half of the bit with cutting inserts in place and half without the inserts, showing only the recesses, and also showing the milled offset recesses into which the diamond cutters are recessed.
Figure 6:
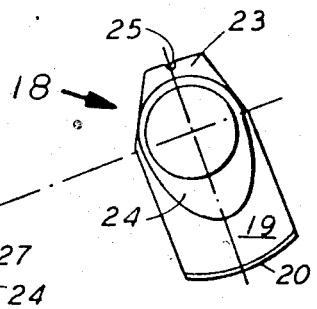
FIG. 6 is a view of one of the cutting inserts in plan relative to the surface on which the cutting element is mounted.

The recesses 15 in crown faces 13 and 14 receive a plurality of cutting elements 18 which are seen in FIGS. 1 and 2 and are shown in substantial detail in FIGS. 3, 5, 6 and 7. Cutting elements 18 are preferably Stratapax cutters manufactured by General Electric Company and described in Daniels, et al. U.S. Pat. No. 4,156,329, Rowley, et al. U.S. Pat. No. 4,073,354 and in considerable detail in Advanced Drilling Techniques by William C. Maurer. The Stratapax cutting elements 18 consist of a cylindrical supporting stud 19 of sintered carbide. Stud 19 is beveled at the bottom as indicated at 20, has edge tapered surfaces 21 and 22, a top tapered surface 23 and an angularly oriented supporting surface 24.

Figure 5:
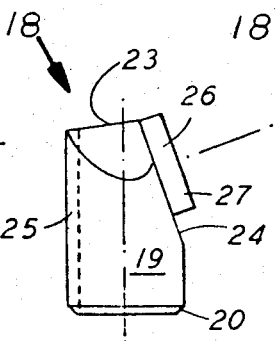
FIG. 5 is a view in side elevation of one of the cutting inserts.
Figure 5A:
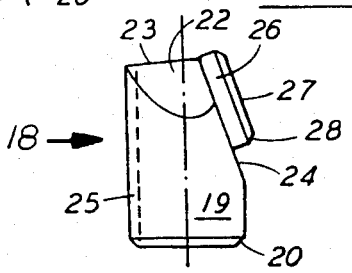
FIG. 5A is a view in side elevation of an alternate embodiment of one of the cutting inserts.
Figure 7:
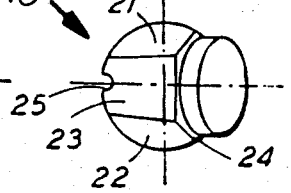
FIG. 7 is a top view of the cutting insert shown in FIG. 5.

A small cylindrical groove 25 is provided along one side of supporting stud 19. A disc shaped cutting element 26 is bonded on angular supporting surface 24, preferably by brazing or the like. Disc shaped cutting element 26 is a sintered carbide disc having a cutting surface 27 comprising polycrystalline diamond. In FIG. 5A, there is shown an alternate form of cutting element 18 in which the cutting surface 27 of polycrystalline diamond on disc shaped cutter 26 is beveled around the peripheral edge as indicated at 28.

The relative size of supporting studs 19 of cutting elements 18 and the diameter of recesses 15 are selected so that cutting elements 18 will have a tight interference fit in the recesses 15. The recesses 15 are oriented so that when the cutting elements are properly positioned therein the disc shaped diamond faced cutters 26 will be positioned with the cutting surfaces facing the direction of rotation of the drill bit.

When the cutting elements 18 are properly positioned in sockets or recesses 15 the cutter disc 26 on supporting stud 19 is aligned with and recessed into the milled offset recess 16 on the edge of socket or recess 15. Because the offset milled recess is cut along a circular curvature at the top edge of recess 15 and intersects substantially less than 180° of that recess, the diamond cutter disc fits snugly in offset recess 16 which restrains the supporting stud 19 from rotation. Also, the fact that recess 15 grips stud 19 around substantially more than 180° insures that the stud and the cutters supported thereon are held more firmly in position.

Drill bit body 2 is provided with a centrally located nozzle passage 30 and a plurality of equally spaced nozzle passages 31 toward the outer part of the bit body. The nozzle passages 30 and 31 are designed to provide for the flow of drilling fluid, i.e. drilling mud or the like, to keep the bit clear of rock particles and debris as it is operated. The details of the nozzle construction constitute this invention and the particular bit body used is described primarily as setting for the normal use of the nozzle.

The outer nozzle passages 31 are preferably positioned in an outward angle of about 10°–25° relative to the longitudinal axis of the bit body. The central nozzle passage 30 is preferably set at an angle of about 30° relative to the longitudinal axis of the bit body. The outward angle of nozzle passages 31 directs the flow of drilling fluid toward the outside of the bore hole and preferably ejects the drilling fluid at about the peak surface of the crown surface on which the cutting inserts are mounted.

This arrangement of nozzle passages and nozzles provides a superior cleaning action for removal of rock particles and debris from the cutting area when the drill bit is being operated. The proximity of the nozzles to the cutting curface, however, causes a problem of excessive wear which has been difficult to overcome. The erosive effect of rock particles at the cutting surface tends to erode the lower end surface of the bit body and also tends to erode the metal surrounding the nozzle pasages. In the past, snap rings have usually been used to hold nozzles in place and these are eroded rapidly during drilling with annoying losses of nozzles in the hole.

The central nozzle passage or duct 30 comprises passage 32 extending from drill body cavity 6 and has a counterbore 33 cut therein providing a shoulder 43. Counterbore 33 is provided with a peripheral groove 34 in which there is positioned an O-ring 35. Counterbore 33 is internally threaded as indicated at **33*a* and opens into an enlarged smooth bore portion 38** which opens through the lower end portion or face of the drill bit body.

A nozzle member 36 is threadedly secured in counterbore 33 against shoulder 43 and has a passage 37 providing a nozzle for discharge of drilling fluid. As noted above, a major problem encountered with drilling nozzles is the frequent plugging with mud or dirt or rock particles. When a drilling nozzle is plugged, it may be necessary to pull the bit and clean the nozzle or replace it. This "trip" of the drill bit is a very expensive procedure.

In this invention, the drilling nozzle 36 has been made self cleaning by means of a unique nozzle passage design. The nozzle passage 37 is provided with a pair of longitudinally extending flutes 137 on opposite sides thereof. These flutes are best seen in section in FIG. 8A and in end view in FIG. 9. If a particle of mud or earth or even rock plugs the main bore of the passage 37, the drilling mud continues to flow through the flutes 137 and erodes the plugging material until the passage opens.

Figure 9A:
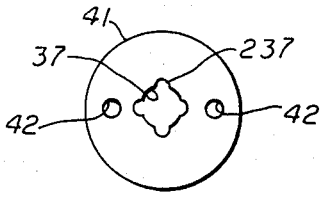
FIG. 9A is an end view of the nozzle member of FIGS. 8 and 8A showing another embodiment of the self cleaning nozzle passage.
Figure 9B:
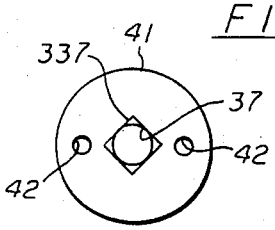
FIG. 9B is an end view of the nozzle member of FIGS. 8 and 8A showing still another embodiment of the self cleaning nozzle passage.
Figure 9C:
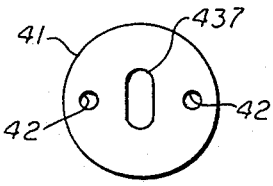
FIG. 9C is an end view of the nozzle member of FIGS. 8 and 8A showing yet another embodiment of the self cleaning nozzle passage.

In FIGS. 9A, 9B, and 9C, there are shown alternate embodiments of the self cleaning nozzle passage. In FIG. 9A, the nozzle passage 37 is provided with four flutes 237 instead of two as in FIG. 9. In FIG. 9B, the flutes 337 are angular grooves instead of rounded grooves. In FIG. 9C, the flutes merge into the body of the nozzle passage so that the passage 437 has a cross section in the shape of a long narrow oval or ellipse. In each case, the important principle involved is that the passage of the nozzle is non-circular in cross section and is sufficiently out of round that a particle plugging the main bore of the nozzle passage leaves openings around the edges through which the drilling mud can flow and erode the plugging particle. The continued flow of drilling mud is sufficient to erode away even a particle of rock to unplug the nozzle.

Nozzle member 36 is a removable and interchangeable member which may be removed for servicing or replacement or for interchange with a nozzle of a different size or shape, as desired. Nozzle member 36 has its main portion formed of a hard metal, e.g. carbide or the like, with a smooth cylindrical exterior 38 and an end flange 39. Since hard metal is substantially unmachinable, it is virtually impossible to form threads in the nozzle member. A steel (or other suitable metal) sleeve 40 is brazed (or otherwise secured) to cylindrical nozzle portion 38 as indicated at 50 and has male threads 51 sized to be threadedly secured in the female threaded portion 33*a* of nozzle counterbore 33.

Figure 8:
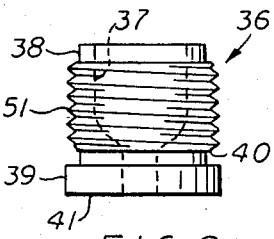
FIG. 8 is a view in elevation of one of the replaceable nozzle members having longitudinal central passage of self cleaning construction.
Figure 9:
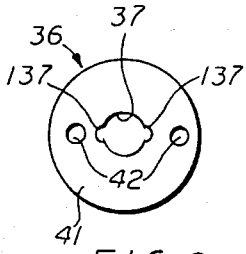
FIG. 9 is an end view of the nozzle member shown in FIGS. 8 and 8A and showing the nozzle passage flutes which provide a self cleaning action.
Figure 8A:
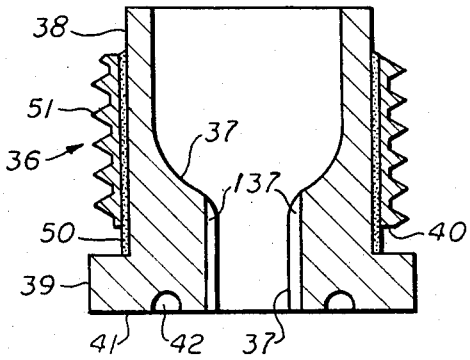
FIG. 8A is a view in central section, slightly enlarged, of the self cleaning nozzle member as shown in FIG. 8.

As seen in FIGS. 8, 8A and 9, the end face 41 of nozzle member 36 has recesses or indentations 42 formed therein which provide for insertion of a suitable wrench or tool for turning the nozzle member 36 to screw or unscrew the same for installation or removal. The peripheral surface of nozzle flange 39 fits the enlarged bore 38 of the nozzle-containing passage so that the nozzle member 36 can be threadedly installed in the position shown, with its end abutting shoulder 43. The face 41 of flange 39 shields the metal of threads 51 from abrasive wear or erosion.

The threaded arrangement for securing nozzle members 36 in place avoids the problem encountered when snap rings are used for retention, viz. erosive wear and breakage of the snap rings with loss of nozzles in the bottom of the boreholes. There is a further problem, however with the threaded connection in that the nozzle may become unscrewed during use and lost in the hole.

This problem can be overcome by use of locking type screw threads but such an arrangement has the disadvantage of making removal and replacement of the nozzles more difficult. Another arrangement for solving this problem is for the apparatus to be provided with a retaining ring 44 which protects the nozzle member 36 and the enlarged bore portion 38 against wear and prevents the nozzles from unscrewing and becoming lost downhole.

In FIG. 10, the nozzle passages 31 are shown in some detail with the nozzle member 36 in place but without the retaining ring 44. In the nozzle passages 31, each nozzle passage 32*a* opens from body cavity 6 and is intersected by counterbore 33*a*. In FIG. 10, nozzle member 36 is shown unsectioned so that only the exterior cylindrical surface is seen. O-ring 35 is seen in full elevation surrounding the cylindrical surface 38 of nozzle member 36 and extending into peripheral groove 34.

There is a considerable advantage to the use of nozzle members threadedly secured as shown in FIGS. 10–12 and particularly extending at the angles described. In FIGS. 11 and 12, the retaining rings 44 are shown in more detail. These rings are press fitted in place and secure the nozzle members 36 against loss by unscrewing. Rings 44 also provide protection to the end of the nozzle members and to the metal of the bit body surrounding the enlarged bore portion 38. In FIG. 12, nozzle member 36 is shown positioned in place against shoulder 43 with the O-ring 35 providing the desired seal against leakage. In this view, retaining ring 44 is shown both in place and in exploded relation.

Retaining ring 44 is an annular ring having a cylindrical outer surface 45 and flat end surfaces 46 and 47. A peripheral bevel 48 is provided at the intersection of outer surface 45 and end face 46. The inner opening 49 is of adequate size to permit unobstructed flow of drilling fluid from nozzle passage 37. Opening 49 may be cylindrical or any other desired configuration, but is preferably a conical surface, as shown, flaring outward toward the end of passage 31 opening through the cutting face 7 of bit body 2. Retaining ring 44 has its outer surface 45 very slightly larger than the inner surface or bore of passage 31 and has an interference fit therein. The bevel 48 on retaining ring 44 permits the ring to be pressed into the slightly smaller bore of passage 31 without cutting or scoring the bit body. The retaining ring 44 is preferably oversize by about 0.002–0.004 inch in relation to the bore of passage 31.

Retaining ring 44 is preferably of a hardened steel or a hard metal, such as sintered tungsten carbide. Retaining rings 44 may be used in the retention of all of the nozzle members 36 against unscrewing. Retaining rings 44 hold nozzle members 36 tightly in place to prevent unscrewing and to protect against erosion or wear during use. Retaining rings 44 can be drilled out or removed by suitably designed tools for exchange or replacement of the nozzle members 36 in the field.

OPERATION

The operation of this drill bit should be apparent from the foregoing description of its component parts and method of assembly. Nevertheless, it is useful to restate the operating characteristics of this novel drill bit to make its novel features and advantages clear and understandable.

The drill bit as shown in the drawings and described above is primarily a rotary bit of the type having fixed diamond surfaced cutting inserts. Most of the features described relate only to the construction of a diamond bit. The use of retaining rings 44 and the threaded, replaceable nozzle members 36, as shown in FIGS. 1, 11, and 12, is of more general application.

This arrangement for retention of the removable and interchangeable nozzle members is useful in a diamond bit as described and shown herein but would also be of like use in providing for the retention of removable and interchangeable nozzle member in roller bits, particularly when equipped with extended nozzles, or any other bits which have a flow of drilling fluid through the bit body and out through a flow directing nozzle. The threaded arrangement for releasably securing the nozzle members in place is therefore considered to be of general application and not specifically restricted to the retention of nozzles in diamond cutter insert type bits.

In operation, this drill bit is rotated by a drill string through the connection by means of the drill collar 4 shown in FIG. 1. Diamond surfaced cutting elements 18 cut into the rock or other earth formations as the bit is rotated and the rock particles and other debris is continuously flushed by drilling fluid, e.g. drilling mud, which flows through the drill string and the interior passage 5 of the drill bit and is ejected through nozzle passages 30 and 31 as previously described.

The central nozzle 30 is set at an angle of about 30° to flush away cuttings and debris from the inside of the cutting crown. The outer nozzle passages 31 are set at an angle of 10°–25° outward relative to the longitudinal axis of the drill bit body. These nozzle passages emerge through the cutting face at about the peak of the crown cutting surface. This causes the drilling fluid to be ejected toward the edges of the bore hole and assists in flushing rock particles and cuttings and debris away from the cutting surface. As noted above in the description of construction and assembly, the nozzle passages 30 and 31 are formed by removable nozzle members 36 which are held in place by threads 51 in sleeve 40 and secured against unscrewing by retaining rings 44 secured by an interference fit.

As described above, the drilling nozzle 36 has been made self cleaning by means of a unique nozzle passage design. The nozzle passage 37 is provided with a pair of longitudinally extending flutes 137 on opposite sides thereof. These flutes are best seen in section in FIG. 8A and in end view in FIG. 9. If a particle of mud or earth or even rock plugs the main bore of the passage 37, the drilling mud continues to flow through the flutes 137 and erodes the plugging material until the passage opens.

In FIGS. 9A, 9B, and 9C, there are shown alternate embodiments of the self cleaning nozzle passage. In FIG. 9A, the nozzle passage 37 is provided with four flutes 237 instead of two as in FIG. 9. In FIG. 9B, the flutes 337 are angular grooves instead of rounded grooves. In FIG. 9C, the flutes merge into the body of the nozzle passage so that the passage 437 has a cross section in the shape of a long narrow oval or ellipse. In each case, the important principle involved is that the passage of the nozzle is non-circular in cross section and is sufficiently out of round that a particle plugging the main bore of the nozzle passage leaves openings around the edges through which the drilling mud can flow and erode the plugging particle. The continued flow of drilling mud is sufficient to erode away even a particle of rock to unplug the nozzle.

The peripheral surface or stabilizer surface 8 of drill bit body 2 is provided with a plurality of sintered carbide cylindrical inserts 12 positioned in sockets or recesses 11 thereof. These inserts protect stabilizer surface 8 against excessive wear and assist in keeping the bore hole to proper gage to prevent the drill bit from binding in the hole. The grooves or courses 10 in stabilizer surface 8 provide for circulation of drilling fluid, i.e. drilling mud, past the drill bit body 2 to remove rock cuttings and debris to the surface.

As previously pointed out, the construction and arrangement of the cutting elements and the method of assembly and retention of these elements is especially important to the operation of this drill bit. The drill bit is designed to cut through very hard rock and is subjected to very substantial stresses. Typical cutting elements 18 are Stratapax cutting elements manufactured by General Electric Company and consist of diamond surfaced cutting discs supported on carbide studs as described above. The milled offset recess 16 adjacent to the socket or recess 15 in which cutting element stud 19 is fitted allows for cutting disc 26 to be partially recessed below the surface of the cutting face of the drill bit and also provides for relieving the stress on the drill bit during the cutting operation. The engagement of cutting disc 26 with the surface of milled offset recess 16 assists in retaining cutting element 18 in position and protecting it against twisting movement during cutting operation of the drill bit.

The arrangement of cutting elements 18 in a spiral pattern on the crown cutting surface, as shown in FIG. 2, provides for a uniform cutting action on the bottom of the bore hole. The cutters 18 which lie on the outer conical cutting surface 15 function to cut the gage of the bore hole and these cutters together with the carbide inserts 12 in the stabilizer surface 8 function to hold the side walls of the bore hole to proper gage and prevent binding of the drill bit in the bore hole.

The specific construction of the drill bit has been given to provide a setting for the use of the novel self cleaning nozzle which constitutes this invention. While the specific construction of drill bit represents a preferred setting for use of the improved drilling nozzle, it should be understood that the nozzle can be used in any drill bit which requires the use of a nozzle. The nozzles can be used in diamond bits, as described herein, or may be used in roller cone bits or percussion bits or the like.

While this invention has been described fully and completely with special emphasis upon a single preferred embodiment, it should be understood that within the scope of the appended claims the invention may be practiced otherwise than as specifically described herein.

I claim:

1. A drill bit with replaceable nozzles comprising:

a drill body having a hollow tubular body adapted to be connected to a drill string, said drill body having an exterior peripheral stabilizer surface and a front end face facing forwardly in the direction of drilling, a plurality of spaced apart diamond cutting disks supported stationarily in cutting position in said front end face, at least one nozzle passage in said drill body comprising a duct opening from the interior of said body and a counterbore aligned therewith which opens through said front end face adjacent to said cutting elements, said passage including a shoulder, a removable self-cleaning nozzle member of abrasive resistant hard metal of an exterior shape mounted within said counterbore and restrained by said shoulder, means securing said nozzle member in position against said shoulder in said counterbore, said nozzle member having a forwardly directed longitudinal passage therethrough for conducting a flow of drilling fluid, said nozzle passage being non-circular in cross-section and sufficiently out-of-round that the portions thereof outside a maximum circular cross-section of said passage define auxiliary passages which are coextensive longitudinal with the center of said longitudinal passage to enable drilling fluid to flow around a particle of material lodged at the center of said passage, said maximum circular cross-section being smaller than the cross-section of said duct.

2. A drill bit according to claim 1, wherein said auxiliary passages comprise at least two longitudinally extending flutes.

3. A drill bit according to claim 2, wherein there are more than two said flutes.

4. A drill bit according to claim 3, wherein there are four said flutes.

* * * * *